US008324992B2

(12) United States Patent
Kurashige et al.

(10) Patent No.: US 8,324,992 B2
(45) Date of Patent: Dec. 4, 2012

(54) ELECTROMAGNETIC CONTACTOR

(75) Inventors: Jun Kurashige, Shibata (JP); Takashi Sato, Shibata (JP); Katsuhiko Shiraishi, Mito (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 325 days.

(21) Appl. No.: 12/691,759

(22) Filed: Jan. 22, 2010

(65) Prior Publication Data

US 2010/0308944 A1 Dec. 9, 2010

(30) Foreign Application Priority Data

Jun. 4, 2009 (JP) ..... 2009-135201

(51) Int. Cl.
*H01H 75/00* (2006.01)
*H01H 77/00* (2006.01)
*H01H 83/00* (2006.01)

(52) U.S. Cl. ..... 335/15; 335/128

(58) Field of Classification Search ..... 335/15, 335/46, 78, 104, 128, 131, 193, 202, 244, 335/245, 247, 249
See application file for complete search history.

(56) References Cited

U.S. PATENT DOCUMENTS

| | | | | |
|---|---|---|---|---|
| 3,196,231 | A * | 7/1965 | Meyer | 335/193 |
| 5,495,220 | A * | 2/1996 | Takaya et al. | 335/274 |
| 5,535,083 | A * | 7/1996 | Sako et al. | 361/38 |
| 2009/0315653 | A1 * | 12/2009 | Suzuki et al. | 335/185 |
| 2011/0156845 | A1 * | 6/2011 | Eum | 335/154 |

FOREIGN PATENT DOCUMENTS

| | | |
|---|---|---|
| JP | 58-140940 | 8/1983 |
| JP | 2008-277010 | 11/2008 |

* cited by examiner

*Primary Examiner* — Bernard Rojas
(74) *Attorney, Agent, or Firm* — Antonelli, Terry, Stout & Kraus, LLP.

(57) ABSTRACT

An electromagnetic contactor includes a fixed core into which a bobbin of an electromagnetic coil is inserted and fitted, a movable core, a movable insulating base, a retracting spring, a fixed insulating base, and a supporting mechanism. The supporting mechanism is inserted into a through-hole formed in a thickness direction of the fixed core, and is configured in such a manner that a buffer spring is arranged between both ends of a supporting member that is arranged so as to protrude from the through-hole and a lower surface of the coil bobbin. An elastic member is provided between the fixed insulating base and a lower surface of the fixed core.

4 Claims, 2 Drawing Sheets

ELECTROMAGNETIC CONTACTOR

BACKGROUND OF THE INVENTION (1) Field of the Invention

The present invention relates to an electromagnetic contactor including a fixed core engaged with a fixed insulating base and a bobbin of an electromagnetic coil, and a movable core which is actuated by the electromagnetic coil and can be attached to or detached from the fixed core, and particularly to an alternating-current electromagnetic contactor which reduces an impact generated when the fixed core and the movable core are attached to each other to improve mechanical endurance.

(2) Description of the Related Art

In a general electromagnetic contactor, a movable core and a fixed core are formed in an E-shape, and are arranged to face an end surface of each leg portion. In addition, by switching a state where the movable core and the fixed core are detached from each other by means of a metal spring or the like and a state where the movable core and the fixed core are attached to each other by means of the drawing force of an electromagnetic coil, a movable contact and a fixed contact become conductive or nonconductive and opening/closing of an electric circuit is controlled.

In order to enhance the durability of the movable core and the fixed core by reducing an impact generated when the movable core and the fixed core collide with each other in a conventional electromagnetic contactor, a buffer member made of an elastic material such as a metal spring is inserted and fitted into a through-hole formed in the thickness direction of the fixed core, and oscillation and collision noise generated when the both of the fixed and movable cores collide with each other are reduced with the buffer member, as described in Japanese Patent Application Laid-Open No. 2008-277010. In addition, a buffer member made of an elastic material such as rubber is arranged between the fixed core and a fixed insulating base to reduce oscillation and collision noise generated when the both cores collide with each other.

However, the buffer members in the above-described conventional technique reduce the oscillation after collision of the movable core and the fixed core, but do not reduce the collision velocity of the both of the movable and fixed cores. On the other hand, mechanical abrasion of contact surfaces of the both of the movable and fixed cores is largely affected by the collision velocity, and it has been necessary to decrease the collision velocity from the past. Further, an elastic material such as rubber may be used as a buffer member. However, a sufficient elasticity can not be obtained due to limitation in dimension of the electromagnetic contactor in the moving direction, thus resulting in a poor buffer effect when the both of the movable and fixed cores collide with each other.

In view of the disadvantages of the above-described conventional technique, the present invention is to provide an electromagnetic contactor in which the collision velocity of both of the movable core and the fixed core is effectively reduced to improve mechanical endurance of an electromagnet.

SUMMARY OF THE INVENTION

In order to solve the above-described problems, the present invention provides an electromagnetic contactor including: a fixed core into which a bobbin of an electromagnetic coil is inserted and fitted; a movable core which is arranged to face the fixed core so as to be attached to or detached from the fixed core; a movable insulating base which supports a movable contact through a contact spring for securing a contact pressure with a fixed contact; a retracting spring which is arranged to detach the movable core from the fixed core; an upper insulating base which supports the fixed contact; a fixed insulating base which accommodates the respective members; and a supporting mechanism which holds the fixed core between the fixed insulating base and the coil bobbin through a buffer spring, wherein the supporting mechanism is inserted into a through-hole formed in the thickness direction of the fixed core, and is configured in such a manner that the buffer spring is arranged between both ends of a supporting member that is arranged so as to protrude from the through-hole and a lower surface of the coil bobbin, an elastic member is provided between the fixed insulating base and a lower surface of the fixed core, and a void is provided at a contact surface between the lower surface of the coil bobbin and the fixed core, and the load of the buffer spring is set smaller than the combined load of the retracting spring and the contact spring in order to move the fixed core towards the movable core by a distance corresponding to the void when being actuated by the electromagnetic coil.

In the electromagnetic contactor, the load of the buffer spring corresponds to that before actuation by the electromagnetic coil, and the combined load of the retracting spring and the contact spring corresponds to that of the both contacts in a conduction state.

In the electromagnetic contactor, when being actuated by the electromagnetic coil, the fixed core collides with the movable core on the movable core side relative to the initial position before actuation, so that a void is formed between the fixed core and the elastic member.

As described above, according to the embodiment, the fixed core is moved once towards the movable core at the time of actuation, and when the drawing force in the alternating-current cycle is decreased, the load of the buffer spring becomes larger, so that the fixed core is started to be returned to the initial position. In this process, the movable core collides with the fixed core, and the relative collision velocity is accordingly decreased, thus improving mechanical endurance.

DETAILED DESCRIPTION OF THE EMBODIMENT

Figure 1:
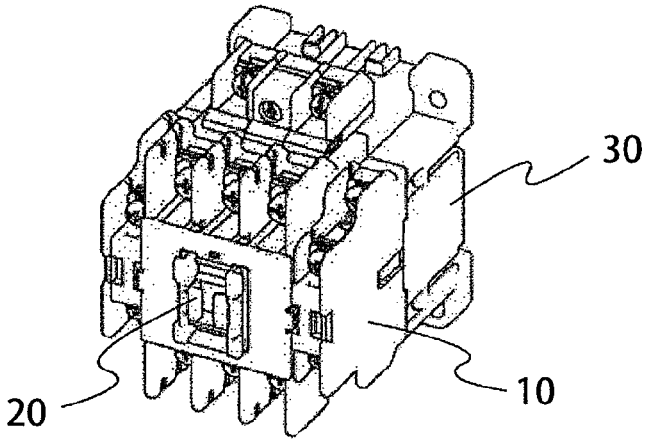
FIG. 1 is an exterior perspective view of an electromagnetic contactor according to an embodiment of the present invention.
Figure 2:
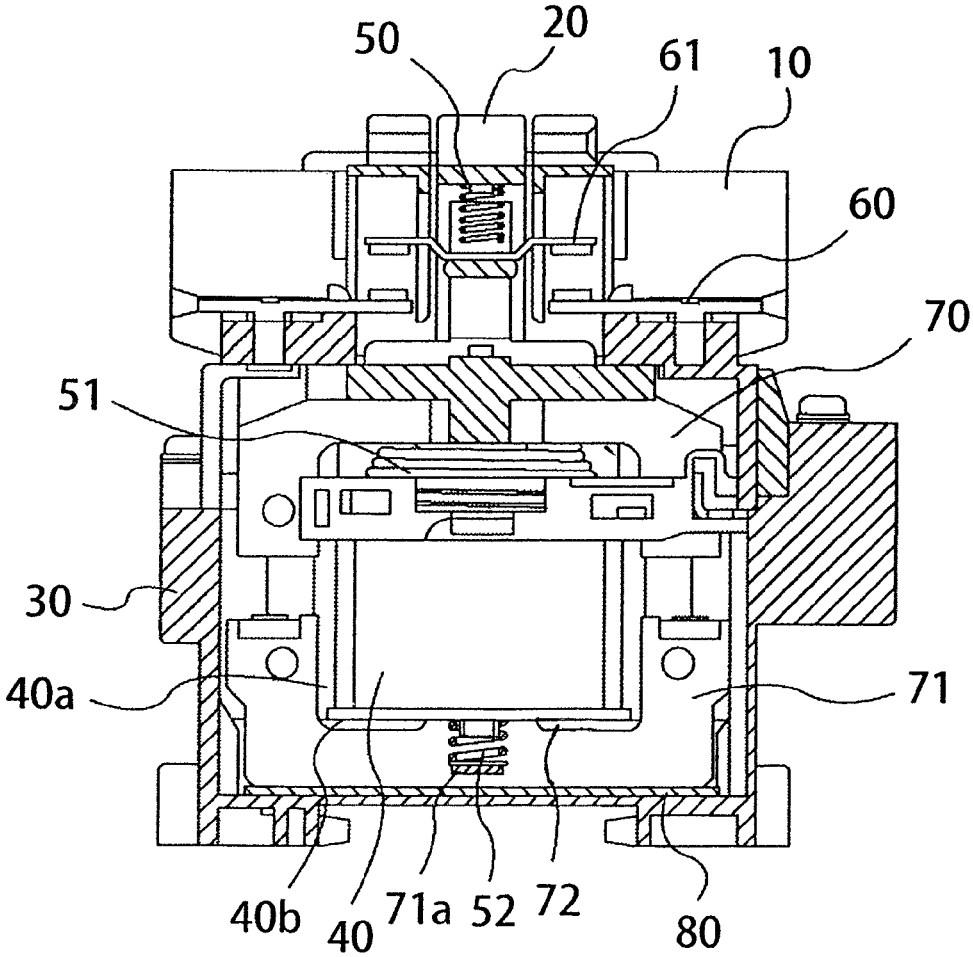
FIG. 2 is a cross-sectional view of the electromagnetic contactor according to the embodiment of the present invention.
Figure 3:
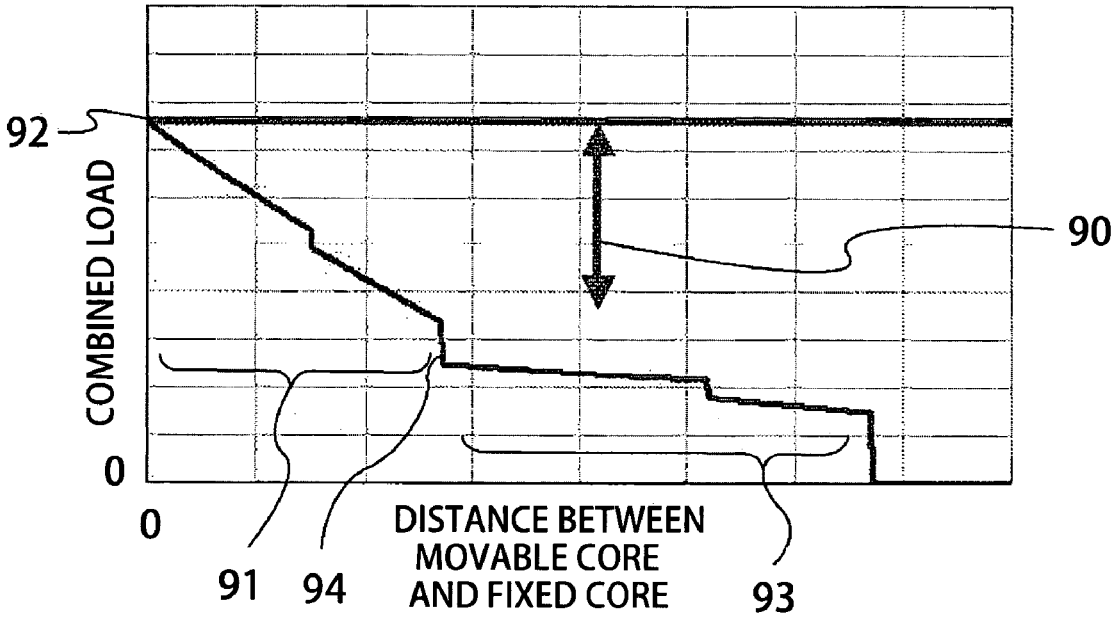
FIG. 3 is a view showing displacement of a combined load caused by actuating a retracting spring and a contact spring and a setting range of a combined load of a buffer spring according to the embodiment of the present invention.
Figure 4:
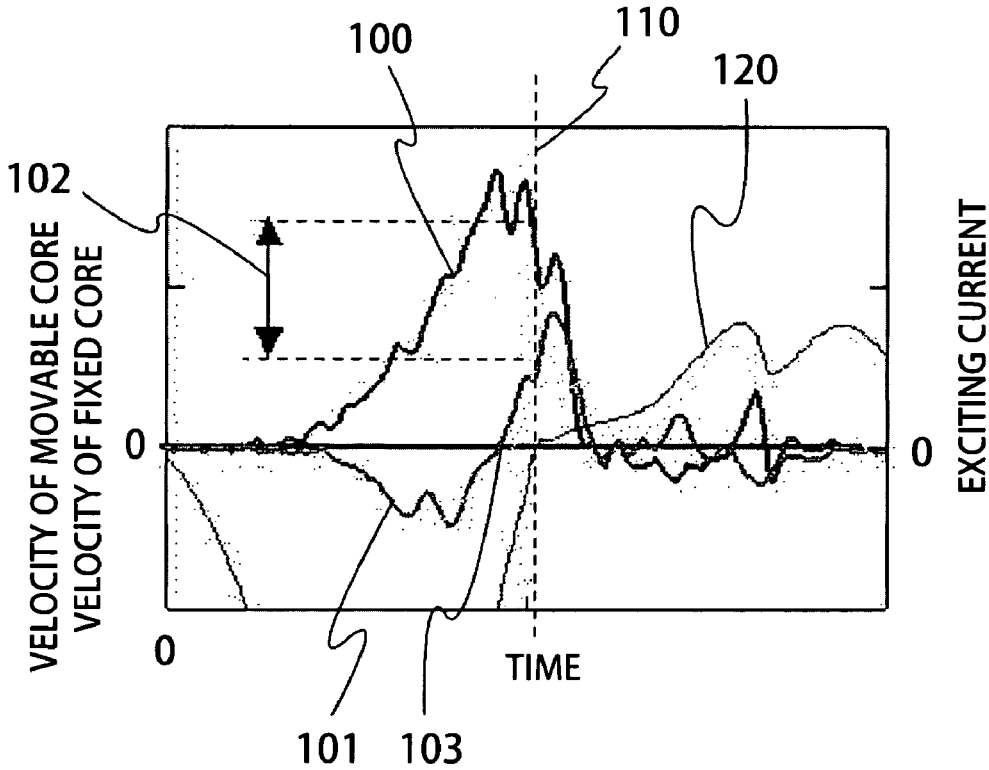
FIG. 4 is an explanation view showing a relation between the velocities of cores and time and between exciting current and time according to the embodiment of the present invention.

An embodiment of the present invention will be described using the drawings. FIG. 1 is an exterior perspective view of an electromagnetic contactor according to an embodiment of the present invention. FIG. 2 is a cross-sectional view of the electromagnetic contactor according to the embodiment of the present invention. FIG. 3 is a view showing displacement of a combined load caused by actuating a retracting spring and a contact spring and a setting range of a combined load of a buffer spring. FIG. 4 is an explanation view showing a relation between the velocities of cores and time and between exciting current and time.

In FIG. 2, the electromagnetic contactor includes a fixed core 71 into which a bobbin 40*a* of an electromagnetic coil 40 is inserted and fitted, a movable core 70 which is arranged to face the fixed core 71 so as to be attached to the fixed core 71 when being actuated by excitation of the electromagnetic coil 40 and so as to be detached therefrom when being not actuated due to release of excitation, a movable insulating base 20 which supports a movable contact 61 through a contact spring 50 for securing a contact pressure with a fixed contact 60, a coil-shaped retracting spring 51 which is arranged so as to detach the movable core 70 from the fixed core 71, an upper insulating base which supports the fixed contact 60, a fixed insulating base 30 which accommodates the respective members, and a supporting mechanism which holds the fixed core 71 between the fixed insulating base 30 and the coil bobbin 40*a* through a buffer spring 52.

The supporting mechanism is inserted into a through-hole formed in the thickness direction of the fixed core 71, and is configured in such a manner that the coil-shaped buffer spring 52 is arranged between both ends of a supporting member 71*a* that is arranged so as to protrude from the through-hole and a lower surface 40*b* of the coil bobbin. An elastic member 80 made of buffer rubber is provided between the fixed insulating base 30 and a lower surface of the fixed core 71, and a void 72 is provided at a contact surface between the lower surface 40*b* of the coil bobbin and the fixed core 71.

In order to move the fixed core 71 towards the movable core 70 by a distance corresponding to the void 72 when being actuated by the electromagnetic coil 40, the load of the buffer spring 52 before actuation by the electromagnetic coil 40 is set smaller than the combined load generated when the retracting spring 51 and the contact spring 50 are attached to each other (when they become conductive). As a method of setting the load, each load of the retracting spring 51 and the contact spring 50 is set before the load of the buffer spring 52 is set.

In the electromagnetic contactor with the above-described configuration, when the movable core 70 is actuated towards the fixed core 71 by excitation of the electromagnetic coil 40, the fixed core 71 is also magnetically drawn towards the movable core 70. The movement of the fixed core 71 towards the movable core 70 by a distance corresponding to the void 72 causes the buffer spring 52 to be bent (compressed) once. When the magnetic drawing force of a sine wave in the alternating-current cycle is decreased, the combined load of the buffer spring 52 becomes larger, and the fixed core 71 is pushed back in the direction opposed to the movable core 70, so that the fixed core is moved in the same direction. On the other hand, the movable core 70 is moved in a wide stroke by excitation of the electromagnetic coil 40, and the core velocity is accordingly high. According to the present invention, the both cores 70 and 71 are allowed to collide with each other in a state where they are moved in the same direction, so that the relative collision velocity of the both cores is decreased.

As shown in FIG. 3, it is necessary to actively move the fixed core 71 towards the movable core 70 in the embodiment. In addition, an initial combined load 90 of the buffer spring 52 is set smaller than a combined load 92 generated when the retracting spring 51 and the contact spring 50 become conductive (when the both cores are attached to each other), so that the fixed core can be actively moved with ease. It should be noted in FIG. 3 that an area 93 represents the load of only the retracting spring 51, 94 represents the position where the movable and fixed contacts are started to be attached to each other, and an area 91 represents the combined load of the retracting spring 51 and the contact spring 50. Here, the load of the buffer spring 52 is set at more than half (0.5 to 0.8) of the combined load of the retracting spring 51 and the contact spring 50.

FIG. 4 is an actual measured example in the embodiment. The reference numeral 120 denotes exciting current which exhibits a current waveform of an alternating-current sine wave at an initial stage of excitation, and the waveform is drastically changed when the both of the movable and fixed cores are attached to (collide with) each other. The timing when the both cores collide with each other is represented by the reference numeral 110. It can be understood that the current waveform is drastically changed after the timing. The reference numeral 100 denotes a moving velocity curve of the movable core 70, and the reference numeral 101 denotes a moving velocity curve of the fixed core 71. The positive side of the vertical axis in the graph represents a moving velocity towards the fixed core 71, and the negative side thereof represents a moving velocity towards the movable core 70. A timing 103 changed from the negative side to the positive side represents a turnaround point where the moving direction towards the movable core 70 is changed towards the fixed core 71. Here, the direction of the fixed core 71 moving towards the movable core 70 is changed to the direction opposed to the movable core 70 at the turnaround point.

The fixed core 71 of a conventional electromagnetic contactor is slightly moved and the moving velocity thereof is approximately 0. Thus, the collision velocity is represented by a movable core velocity curve 100 itself of the movable core 70. In the electromagnetic contactor of the embodiment, the movable core 70 is moved towards the fixed core 71, and the fixed core 71 is moved towards the movable core 70 at an initial actuating stage. However, the moving direction of the fixed core 71 is changed (shown by the turnaround point 103) to the same direction as the movable core 70 from a certain time, in accordance with the relation between the combined load of the buffer spring 52 and the magnetic drawing force (decrease in the magnetic drawing force in the alternating-current cycle) as described above. Thereafter, the movable core 70 and the fixed core 71 are moved in the same direction and collide with each other at the timing 110.

Therefore, the collision velocity of the both cores is considerably decreased to a relative velocity difference (shown by the reference numeral 102 of FIG. 4) between the both cores moving in the same direction. Further, the fixed core 71 collides with the movable core 70 on the movable core 70 side relative to the initial position before actuation, so that a void is produced between the fixed core 71 and the buffer rubber 80 at the time of collision, and a space where the fixed core 71 can be moved to the buffer rubber 80 can be secured after collision, thus improving buffer effects after collision of the cores.

As described above, according to the embodiment, the fixed core is moved once towards the movable core at the time of actuation, and when the drawing force in the alternating-current cycle is decreased, the load of the buffer spring becomes larger, so that the fixed core is started to be returned to the initial position. In this process, the movable core collides with the fixed core, and the relative collision velocity is accordingly decreased, thus improving mechanical endurance.

What is claimed is:

1. An electromagnetic contactor comprising:

a fixed core into which a bobbin of an electromagnetic coil is inserted and fitted;

a movable core which is arranged to face the fixed core so as to be attached to or detached from the fixed core;

a movable insulating base which supports a movable contact through a contact spring for securing a contact pressure with a fixed contact;

a retracting spring which is arranged to detach the movable core from the fixed core;

a fixed insulating base which accommodates the respective members to support the fixed contact; and a supporting mechanism which holds the fixed core between the fixed insulating base and the coil bobbin through a buffer spring, wherein the supporting mechanism is inserted into a through-hole formed in the thickness direction of the fixed core, and is configured in such a manner that the buffer spring is arranged between both ends of a supporting member that is arranged so as to protrude from the through-hole and a lower surface of the coil bobbin, an elastic member is provided between the fixed insulating base and a lower surface of the fixed core, and a void is provided at a contact surface between the lower surface of the coil bobbin and the fixed core, and the load of the buffer spring is set smaller than the combined load of the retracting spring and the contact spring in order to move the fixed core towards the movable core by a distance corresponding to the void when being actuated by the electromagnetic coil.

2. The electromagnetic contactor according to claim 1, wherein the load of the buffer spring corresponds to that before actuation by the electromagnetic coil, and the combined load of the retracting spring and the contact spring corresponds to that of the both contacts in a conduction state.

3. The electromagnetic contactor according to claim 1, wherein when being actuated by the electromagnetic coil, the fixed core collides with the movable core on the movable core side relative to the initial position before actuation, so that a void is formed between the fixed core and the elastic member.

4. The electromagnetic contactor according to claim 2, wherein when being actuated by the electromagnetic coil, the fixed core collides with the movable core on the movable core side relative to the initial position before actuation, so that a void is formed between the fixed core and the elastic member.

* * * * *